United States Patent [19]

Belbel et al.

[11] Patent Number: 4,659,888

[45] Date of Patent: Apr. 21, 1987

[54] SWITCH DEVICE HAVING AN INSULATING SCREEN INSERTED BETWEEN THE CONTACTS DURING BREAKING

[75] Inventors: Elie Belbel, Epinay sur Seine; Christian Blanchard, Nanterre; André Haury, Le Raincy; Michel Lauraire, Courbevoie, all of France

[73] Assignee: La Telemecanique Electrique, France

[21] Appl. No.: 812,599

[22] Filed: Dec. 23, 1985

[30] Foreign Application Priority Data

Dec. 28, 1984 [FR] France ..... 84 19993

[51] Int. Cl.[4] ..... H01H 9/32

[52] U.S. Cl. ..... 200/151

[58] Field of Search ..... 200/151, 144 R

[56] References Cited

U.S. PATENT DOCUMENTS 3,549,840 12/1970 Harner ..... 200/151 X
3,842,228 10/1974 Green ..... 200/151
4,467,298 8/1984 Belbel et al. ..... 200/151 X

FOREIGN PATENT DOCUMENTS 1238660 10/1959 France ..... 200/151

*Primary Examiner*—Mark O. Budd
*Attorney, Agent, or Firm*—William A. Drucker

[57] ABSTRACT

An electric switch is provided using an isolating screen for destabilizing the arc. The pieces supporting the contacts are equipped with conducting extensions whose conformation and orientation allow the feet of the arc to circulate there without becoming stationary or coming back towards the contacts when the end of the screen moves towards a slot which receives it and when the mobile support effects an appropriate travel.

7 Claims, 2 Drawing Figures

SWITCH DEVICE HAVING AN INSULATING SCREEN INSERTED BETWEEN THE CONTACTS DURING BREAKING

BACKGROUND OF THE INVENTION

1. Field of the Invention

The invention relates to a screened switching apparatus having, on the one hand, two contact pieces movable with respect to each other between a closed state in which the contact inserts are touching and an open state in which the inserts are separated and, on the other hand, an isolating screen which comes rapidly between the inserts by moving from a starting position to a work position, during which movement the arc appearing on opening is displaced by an active edge of the screen and at the end of which the arc is totally destabilized.

2. Description of the Prior Art

Electric switches are already known using arc deflector devices in the form of horns placed in the vicinity of the contact inserts at the free ends of the contact pieces and which have, with respect to the general direction of these pieces, a change of orientation such that the natural development of the arc formed under the effect of the electrodynamic repulsion forces brings the feet of these arcs onto these horns and consequently preventing them from remaining on said inserts.

The orientations, curvatures, shapes or positions given to these horns are essentially based on the assumption that the current which flows in the arc is sufficiently high for this development to be possible; the same measures may be taken if development or swelling of the arc is assisted by the presence of a local magnetic field which may be induced or permanent and which is suitably orientated to promote rapidity of the displacement.

In these known devices, the desired increase of the arc tension results from its extension, whereas the fact of installing the feet of these arcs on the horns avoids consumption of the noble metal of the contact inserts; in such known devices, the orientations of these horns are generally divergent.

When, in order to obtain limitation of the arc current the length of this latter is not greatly increased (for example, because it is not possible to give high amplitude movements to the mobile contact), when the arc current which it is desired to limit does not reach the thresholds from which the presence of the electrodynamic repulsion forces may be readily used, or when the conformation, respectively the construction of the quenching chamber or of the adjacent conductors prevent free expansion of the arc or respectively splitting up of the arc on fins, artificial means are used for destabilizing the arc; an isolating screen rapidly interposed between two contacts which have just opened forms one of them and has numerous advantages, provided that modifications are made to the characteristics of the arc which will be other than its length, and which will still have as result an increase of its tension.

Since important factors in destabilization of the arc require a high speed of the active edge of the screen and quenching of this arc against an isolating wall, in this case it is necessary to take into account the fact that the contact inserts have not the time to move apart by an appreciable distance when the screen moves between them, and that the arc is confined in the vicinity of the contacts by walls of the case.

The result is that, lacking special measures, the arc which tends then to follow a path of minimum length risks remaining unduly on these inserts and consequently causing deterioration thereof which adversely affects the quality of subsequent switching or closure.

SUMMARY OF THE INVENTION

The invention therefore proposes making improvements to a screen switch, whose general construction corresponds to the one mentioned above, which are adapted to considerably reduce the wear of the contact inserts and, consequently to practically eliminate the disadvantages due to such wear, in particular when the caliber of the switch, the level of the fault currents to be interrupted and the size of the apparatus which uses it make the use of other means difficult.

In accordance with the invention, the aim sought is reached because each support piece comprises, beyond the corresponding insert, an extension respectively conductor deflector, these extensions being orientated or formed so that, for each pair of positions of the contacts and of the edge of the screen, following the passage of this latter between the inserts, there exists between two points of these extensions a possible arc path which passes through a point of this edge and which is shorter than the path passing at that moment through the inserts and said point of the edge.

It will clearly appear from other measures that, though the use of horns for promoting swelling of the arcs and displacement of their feet is well known per se, the particular circumstances in which the invention uses them and the conformations which are given them, are radically opposed to those which are usually considered as favorable in conventional switches.

It must finally be understood that, although the measures defined in the invention provide a particular benefit when they are applied to a switch device whose caliber is not very high, the same measures can also be used in apparatus of larger calibers, in which the fear of an increase of the moving mass resulting from the presence of the extensions is not justified if the small travel distances are taken into account which are effected on the one hand by the screen and on the other by the mobile contact of the switch which uses it.

BRIEF DESCRIPTION OF THE DRAWINGS

The invention will be better understood from reading the following description with reference to the accompanying Figures in which.

DESCRIPTION OF THE PREFERRED EMBODIMENT

Figure 1:
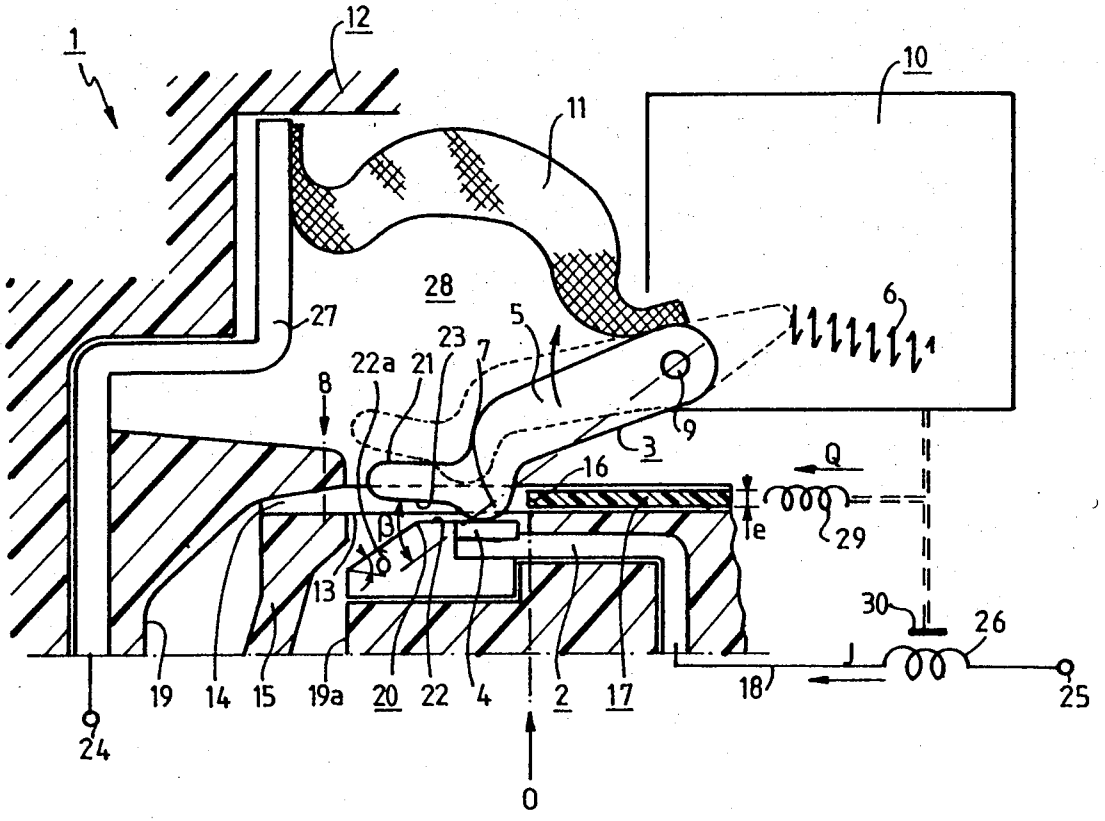
FIG. 1 is an elevational view passing through a plane containing the two contact pieces of a switch in the closed state forming one non limitative embodiment of this invention.

A switch 1, see FIG. 1, incorporating the invention comprises mainly a first contact piece 2 which is here fixed and which therefore carries a fixed contact insert 4, a mobile contact piece 3, which is here represented by a lever 5 pivoting about a pin 9 and having a mobile contact 7, resilient means 6 which provide the required contact pressure, a flexible current feed conductor 11, a mechanical means 10 for causing opening of the contacts, a thin isolating screen 17 which is guided inside an insulating case 12 for example along grooves 13 thereof for establishing efficient insulation between its two opposite faces and a transverse slot or groove 14 formed in a wall 15 of the case, which is connected to an expansion channel 19 and which is placed in the vicinity of the switch for receiving the edge 16 of the screen when this latter moves leftwards between a starting or rest point 10 and an arrival or work point 8.

Screen 17 may for example be propelled on the appearance of an over current J by mechanism 10 when this latter is released by the effects of a coil 26 placed in series in the circuit 18 which also comprises a conductor 27 between the terminals 24, 25; in a first variant, the screen may be propelled by a previously set resilient means 29 which is itself released by a plate, or core, or striker 30 associated with coil 26 or by the mechanism 10.

Resetting means not shown are provided for resetting the mobile contact and the screen, after automatic opening, in rest positions identical to those in FIG. 1.

In a preferred embodiment of the switch, the edge of the screen arrives at a high speed between the two contact inserts, when they are momentarily separated by a distance slightly greater than its thickness -e- . It then causes destabilization of the arc at the moment when it comes into abutment against the wall or else when the front edge of the screen penetrates into the slot 14 when this latter exists.

In a switch which only comprised the elements which have just been mentioned, displacement of the screen would cause, for a given arc current, deformation thereof during which the feet of the arcs would remain fixed on the contact inserts, whereas its column would be progressively pushed back by the edge of the screen as far as the slot.

In order to avoid this phenomenon of the arc feet remaining on the contact inserts, the contact pieces have been provided with conducting, respectively deflecting extensions 20, 21 which are directed in the same direction of movement Q as the screen, and whose opposite surfaces 22, 23, contrary to the prior arrangements of the horns, practically do not diverge, at least on regions immediately adjacent these inserts.

Figure 2:
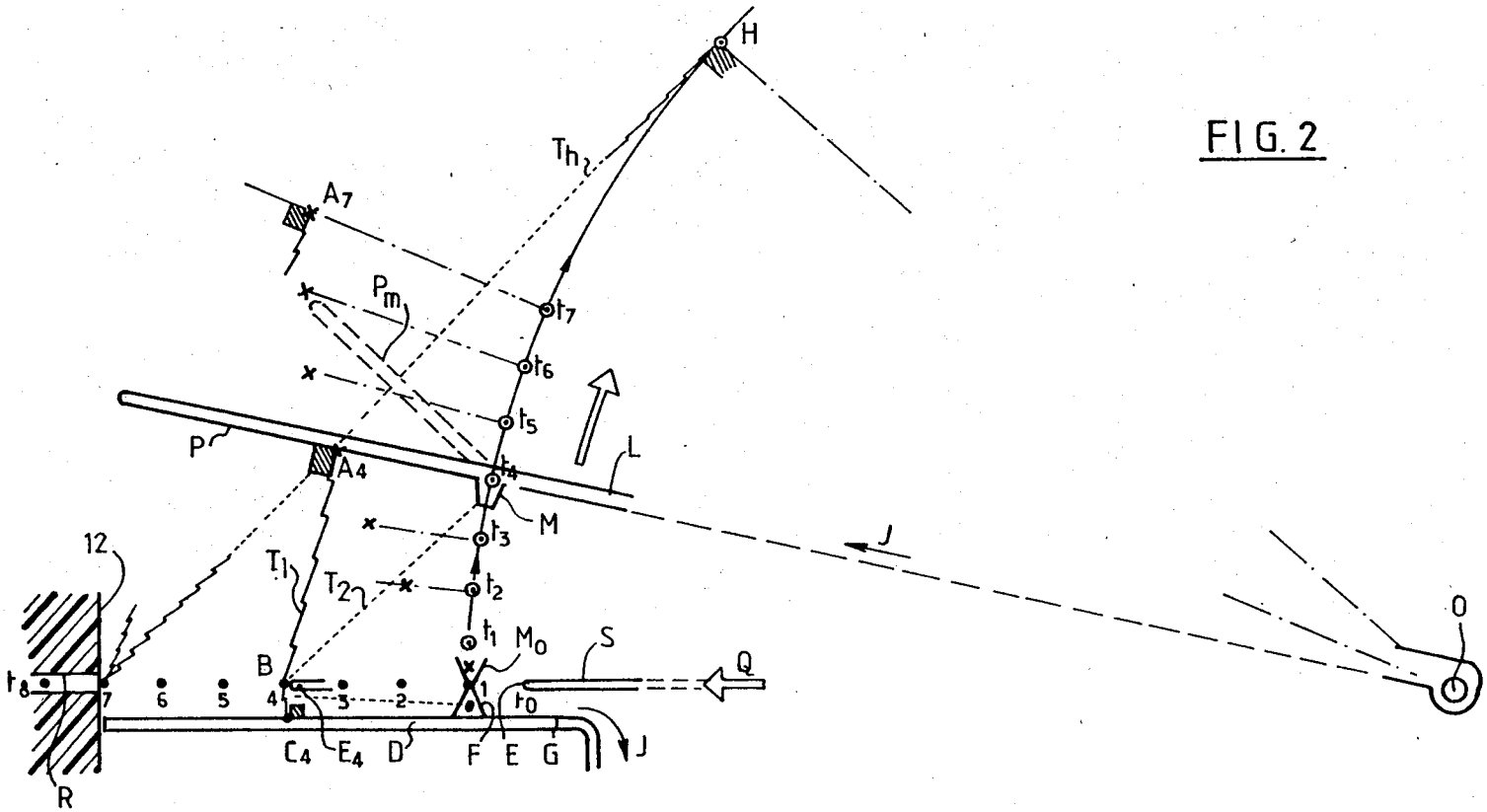
FIG. 2 shows schematically and non limitatively the way in which the displacement of the arc in a switch of the invention may occur.

The length and curvature of these surfaces are chosen, see FIG. 2, so that, for each pair of states or positions of the mobile pieces of the switch and of positions of the screen, there exist between two respective points A and B of these surfaces and a point C of the edge of the screen a path of minimum possible length $T_1$ which the arc will tend to choose rather than taking a hypothetical longer path $T_2$ passing through the points DCE, where D and E are situated on the contact inserts.

Execution of such a hypothetical path $T_2$ which would form, between points D and E, an arc tension $V_2$ greater than the tension $V_1$ which is formed in the other case, has no possibility of being proved correct because of the additional expenditure of energy which it requires; experimentation substantiates this statement, whose results may be forecast when we take into account the relation relating the arc tension and its geometrical dimensions: $V=J_{\sigma}L/S$ where L is the length of the arc, S its section, $\sigma$ its conductivity and J the intensity of the current which flows through it.

In an interesting application of the invention, in which the case 12 contains an automatic switch of modular type, whose nominal caliber is relatively low, the quenching chamber 28 and so the deflection of the mobile contact are of small dimensions.

It should be understood that the material arrangements which contribute to obtaining the desired result, namely the existance of a possible path of minimum length $T_1$, such as defined above, result more particularly from a thorough study or experimental chart of the relative movements of the mobile contact of the screen, without for all that the part played by the electrodynamic repulsion forces and so by the arc current being neglected.

Among these material arrangements may be mentioned the fact that the surfaces where the arc feet circulate extend preferably as far as the vicinity of the slot of the case in which the end of the screen penetrates, and the fact that the angular distance travelled over by the mobile contact when it is carried by a pivoting lever must not be too high so as not to establish, for a certain relative position of the screen and of the lever, a shorter path than the one existing for an immediately preceding relative position.

In FIG. 2, where it is assumed that lever L pivoting about the axis O carries the mobile contact M and an aligned extension P, and where the support G for the fixed contact F is itself extended by a radial deflector D, it has been shown how an arc of short length such as ABC (assuming that its feet are normal to the surfaces where they engaged) may be established and forceably displaced, without its feet affecting the contact inserts, when an edge E of the screen S passes between the contacts after opening thereof. It has been assumed that the pairs of states, or positions, of the screen and of the mobile contact are governed by constant speeds which cause them to pass simultaneously through points 1, 2, 3..7; it is clear from this simplified example of possible operation that the arc passing through BCA is necessarily shorter than the one passing through MCF and that the points M and F will therefore not be concerned by the arc.

If, on the other hand, because of its opening speed and its travel amplitude, the mobile contact were at point H at the moment when the end of the screen is not yet engaged in slot R, the shortest arc path $T_h$ would pass through the mobile contact; this example shows that a substantially radial extension parallel to the direction of the deflector combined with limited opening of the contacts may satisfy the desired aim. As can be seen in FIG. 2, an extension $P_m$ forming with the direction of lever L an angle $\alpha$ which is too great and directed in the opening direction, would also hold an arc foot on the mobile contact M during opening. The described phenomena occur naturally in the same way if the two contacts are mobile, for example in a symmetry of movement with respect to the plane of the screen.

In the embodiment shown in FIG. 2, where the pivoting point O of lever L is close to the displacement plane of the screen, an extension P passing substantially through this point gives satisfaction when the travel of the mobile contact stops at point $t_7$.

In the embodiment shown in FIG. 1, where the pivoting point 9 of lever 3 is placed substantially above the displacement plane of screen 17, extension 21 which is substantially parallel to region 22 close to the fixed contact insert 14 at the time of opening forms an angle $\beta$ with the general direction of the lever passing through points 9 and 7, whereas the deflector 20 itself has a surface 22*a* forming an angle $\delta$ with the general direction of the conducting support 2, itself parallel to the screen. The angular travel of the lever is here also relatively small, which allows a mechanism 10 of reduced volume to be used.

These arrangements do not affect the appearance of the above mentioned phenomena when the screen moves at a speed appropriate to that of the mobile contact.

The presence of the inclined surface 22*a* further promotes removal of the gases appearing at the time of quenching towards a discharge channel 19*a*.

The general arrangements illustrated in FIG. 2 have shown experimentally the excellent quality of an automatic break on a short circuit, although the form of the loop followed by conductors 27, 11, 5 and 2 for constructional reasons is only formed imperfectly.

What is claimed is:

1. A switching apparatus including in a small-size housing a contacting structure which comprises first and second contact supports respectively provided with first and second contact elements, said first and second contact supports being movable with respect to each other between a closed state in which said contact elements have contact surfaces bearing on each other and open state in which said contact elements are separated from each other; an isolating screen slidably mounted in said housing and guided in a determined plane by guiding means, said plane passing through a space portion located between said contact surfaces in said open state, an insulated wall extending perpendicularly to said plane, mechanical means for causing opening of the contacts, a tripping mechanism adapted for propelling said screen from a first position which corresponds to said closed state of the contact elements wherein said screen is distant from said contact elements to a second position which corresponds to said open state of the contact elements wherein said screen passes between said contact elements and has a forward edge which comes into abutment against said wall, coupling means between said tripping mechanism and said mechanical means, said coupling means being adapted so as to synchronize opening of the contacts and releasing of the tripping means in such a manner that the forward end of the screen arrives between the two contact elements at a high speed when said contact elements are momentarily separated by a distance slightly greater than the thickness of said screen, first and second conducting extensions extending towards said wall respectively from said first and second contact suppots, said conducting extensions comprising two arc guiding opposite surfaces each having at least in a first region adjacent to a corresponding contact element, a portion substantially parallel to said plane and an end portion which is close to said insulated wall said contacting structure further having, for each pair of positions of the contact supports and of the edge of the screen, following the passage of said screen between said contact elements, a possible arc path which extends between two points of said opposite surfaces and which passes through a point of said forward edge, said possible arc path being shorter than an arc path extending between said contact elements and passing through said point of the edge and said two points moving along said arc guiding surfaces while the contact supports are opening.

2. The switching apparatus as claimed in claim 1, wherein the wall comprises a slot in which the screen penetrates at the end of movement.

3. The switching apparatus as claimed in claim 1, wherein said opposite surfaces are substantially parallel in said closed state.

4. The switching apparatus as claimed in claim 3, wherein said first contact support is pivotally mounted about a pivoting axis located close to said plane.

5. The switching apparatus according to claim 1, wherein said first contact support is pivotally mounted about a pivoting axis located substantially above said plane and the arc guiding surface of said first conducting extension forms an angle with a direction passing through said first contact element and through said pivoting axis.

6. The switching apparatus according to claim 5, wherein the second contact support is fixedly mounted to the housing and comprises an arc guiding surface having an inclined region which follows said first region.

7. The switching apparatus as claimed in claim 1, wherein said first and second contact supports are pivotally mounted about two respective pivoting axes placed on each side of said plane.

* * * * *